United States Patent [19]

Rogalla

[11] Patent Number: 4,686,121

[45] Date of Patent: Aug. 11, 1987

[54] TREATING APPARATUS AND METHOD

[75] Inventor: Lyle H. Rogalla, Hugo, Minn.

[73] Assignee: Environmental Air Contractors, Inc., St. Paul, Minn.

[21] Appl. No.: 840,062

[22] Filed: Mar. 17, 1986

[51] Int. Cl.[4] ..... B05C 3/00; B05D 1/18; B05D 3/02; F26B 19/00

[52] U.S. Cl. ..... 427/378; 34/61; 34/109; 34/209; 118/423; 118/428; 118/429; 427/382; 427/408; 427/440

[58] Field of Search ..... 118/416, 423, 426, 429, 118/428; 427/377, 378, 408, 440, 382; 34/61, 109

[56] References Cited

U.S. PATENT DOCUMENTS

| | | | |
|---|---|---|---|
| 2,559,286 | 7/1951 | Downes | 427/440 X |
| 4,299,189 | 11/1981 | Hagberg et al. | 118/426 X |
| 4,336,279 | 6/1982 | Metzger | 427/378 X |

*Primary Examiner*—Michael R. Losignan
*Attorney, Agent, or Firm*—Jacobson & Johnson

[57] ABSTRACT

This invention comprises a treating apparatus and method that, in one continuous process, applies a treating solution to a wood article by utilizing a radial dipping apparatus, removes excess treating solution from the treated wood article, dries the remaining protective coating on the wood article by utilizing a radial drying apparatus, and then, if desired, paints the coated article and finally cures the paint to provide immediate assembly of the wood article into a window or door frame.

23 Claims, 4 Drawing Figures

TREATING APPARATUS AND METHOD

BACKGROUND OF THE INVENTION

1. Field of the Invention

This invention relates generally to a drying apparatus and system for treating and curing coatings on wood articles and, more particularly, to apparatus and method that, in one continuous process, applies a protective coating to a wood article, dries the protective coating, paints the coated article and then cures the paint to provide a ready-to-use wood article.

2. Description of the Prior Art

Prior to assembly of windows or door frames, manufacturers have had to treat the unassembled wood frame components with wood preservatives such as fungicides and the like to prevent the wood from rotting. In order to maintain the dimensional stability of the wood frame, waxes and other materials known as stabilizers are impregnated into the wood components to prevent the wood from absorbing moisture.

Typically, the fungicides, stabilizers and the like are applied at the same time by immersing the wood frame components in a solution containing both the fungicides and the stabilizers.

After applying a coating of treating solution to the wood frame component, the coating is allowed to air dry on the surface of the wood. The wood frame component can be left to air dry (i.e., in an unpainted condition) for later painting by the homeowners; however, in some instances it is desired to paint the coated frame component before it is assembled in the frame.

Various radial dipping methods and apparatus are known in the art. Typical apparatus are shown in U.S. Pat. Nos. 3,779,034, 1,274,830, 1,997,013 and 4,299,189. Basically, these patents teach radial dipping methods for quenching molten steel, pickling and electroplating conduit pipes, applying sealant to metal cans, and impregnating plates.

U.S. Pat. No. 2,559,286 teaches a vertical dunking method that applies preservative to wood articles by dropping the articles from a sufficient height so that the articles completely submerge themselves in a dipping tank.

Basically, the aforementioned apparatus and methods are unsuitable for applying treating solutions to wood articles such as window and door frame components. In order to treat window and wood frame parts, the art conventionally uses a bulk treating method which involves pallet treating of stacks of articles by immersing a pallet load of stacked articles directly into a large open top tank containing a treating solution.

The pallet treating is disadvantageous for a number of reasons. First, when a stacked pallet load of articles are dipped into the liquid preservative the stacking prevents direct contact of the preservative to the areas in which the wood articles are stacked on one another. Second, the pallet dipping apparatus generally requires large open dipping tanks (2,000 gallons or more) which have a large surface area for escape of toxic chemicals into the environment. Third, the wood articles have to be immersed in the liquid preservative for sufficient time to allow the solution to seep between the stacked articles which oftentimes permits as much as 30 pounds of excess preservative to seep into the pallet load of wood articles. Fourth, the wet, saturated wood articles are air dried for 48 hours, which permits escape of toxic chemical gasses into the environment. Fifth, the 48 hour in-process inventory stockpile severely delays further processing of the wood articles. Sixth, in order for the pallet system to operate properly and safely, the voluminous escape of the toxic chemical gasses requires costly installation of a large-scale ventilation system.

While the vertical dunking method taught by the U.S. Pat. No. 2,559,286 overcame some of the shortcomings of the pallet dipping method, it is still ill suited for inline coating of wood articles because it is subject to uneven coating produced by turbulence created by plunging the article into the treating solution.

In contrast to the pallet dipping method, the present invention permits one to apply a preservative to the exterior surfaces of a single wood article and have the wood article ready for painting in a matter of a few minutes while prior art process such as the pallet dipping process requires 48 hours or more to air dry the article.

BRIEF SUMMARY OF THE INVENTION

Briefly, this invention comprises an apparatus and method for applying a treating solution to a wood article, removing any excess treating solution from the wood article, drying the remaining solution on the article and then, if desired, painting the article and then curing the paint in one continuous operation.

GENERAL DESCRIPTION OF THE PREFERRED EMBODIMENT OF THE INVENTION

Figure 1:
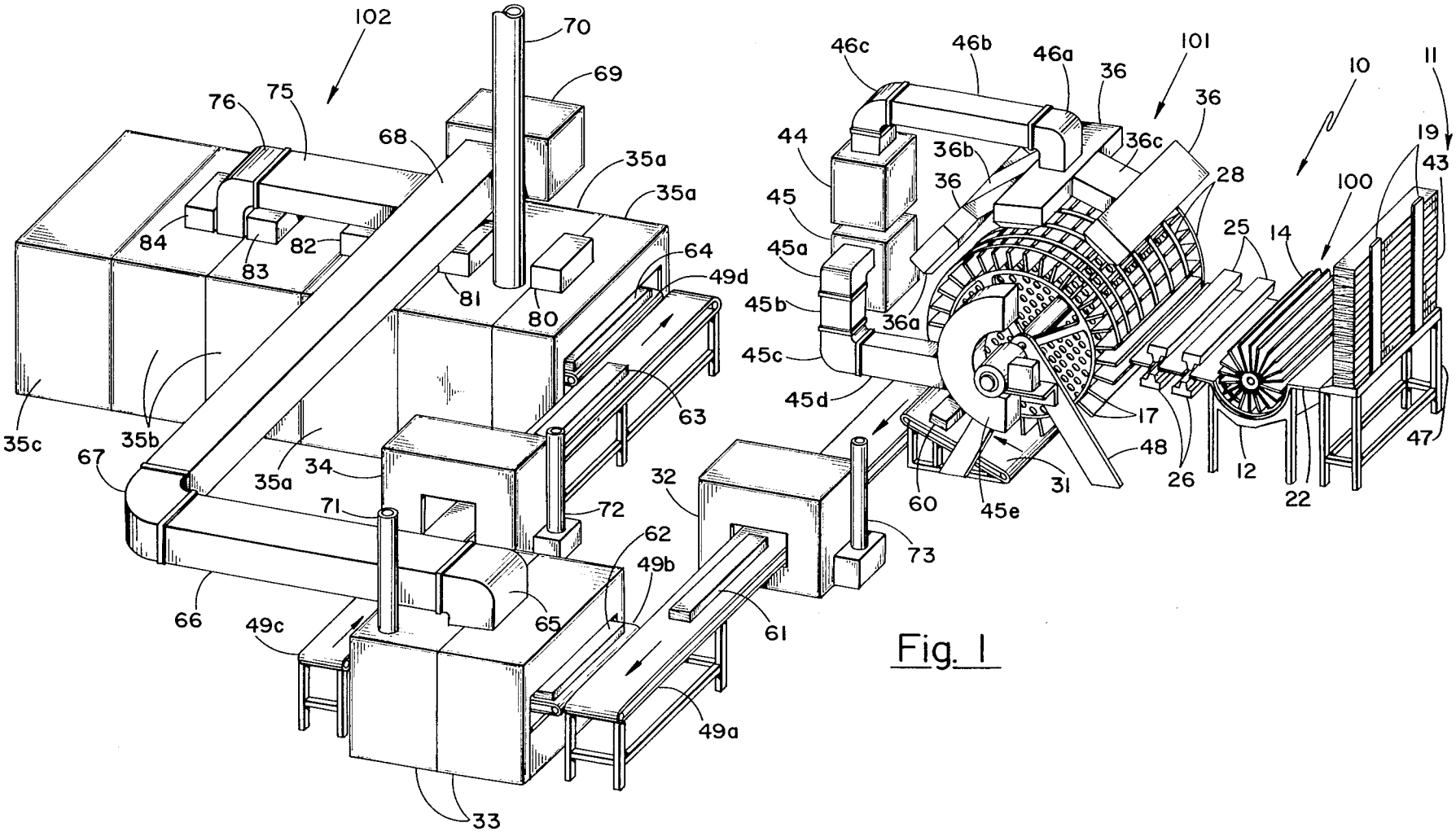
FIG. 1 is a perspective view of the work stations, including the dipping and drying apparatus.

Referring to the drawings, FIG. 1 shows a radial treating and drying system generally designated by reference numeral 10. system 10 comprises a magazine loader 11, a radial dipping apparatus 100, a plurality of air knives 25, 26, a radial air drying apparatus 101 and a plurality of work stations 102.

Figure 3:
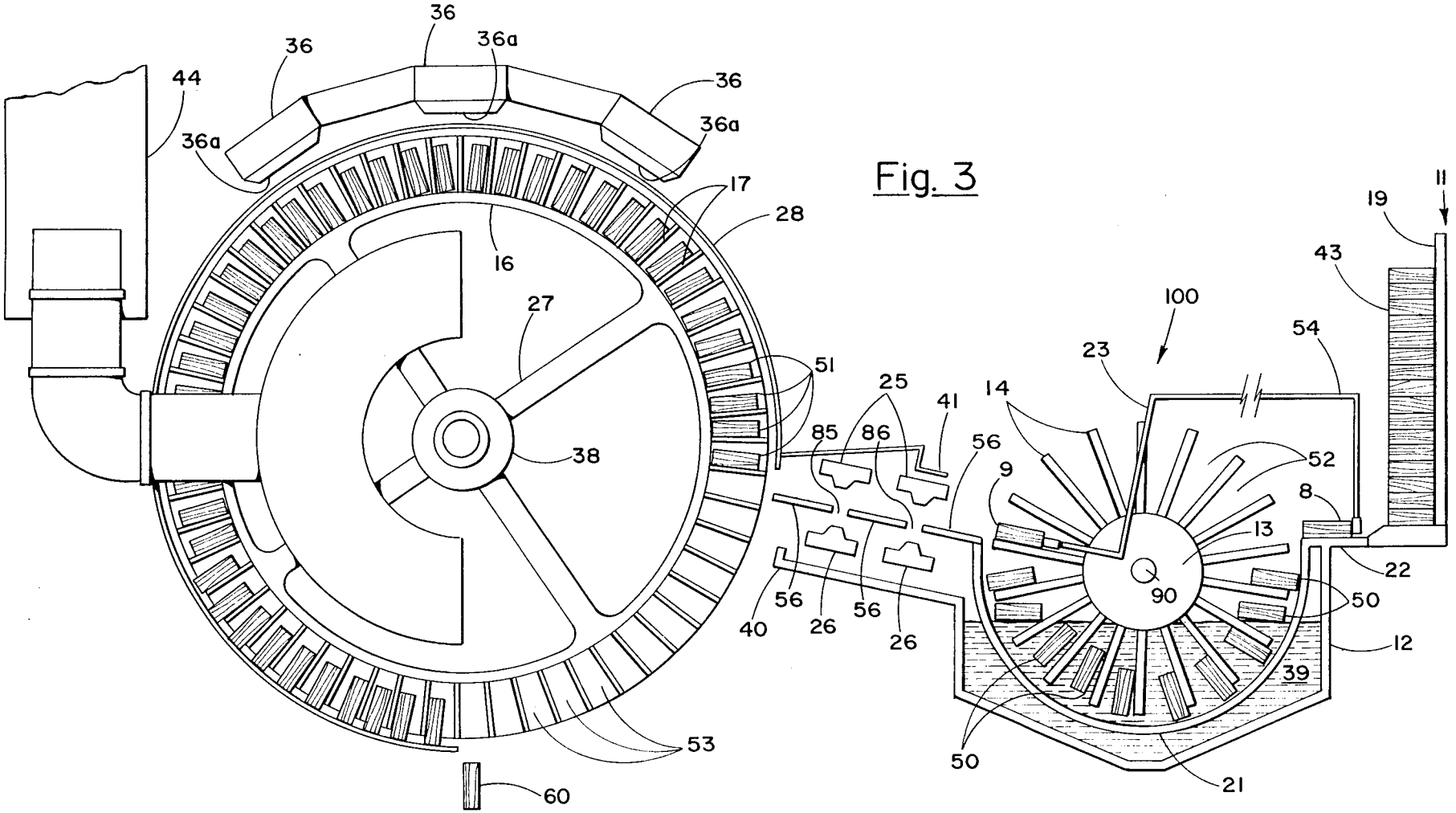
FIG. 3 is a schematic view of the work stations of FIG. 2.

Referring to FIG. 1 and FIG. 3 magazine loader 11 holds a stack of untreated wood articles 43 which are periodically and individually dispensed to radial dipping apparatus 100 by an ejection member 54. Typically, wood articles 43 are unassembled window and door frame components that are to be used in manufacture assembly of window and door frames. FIG. 3 shows in schematic form radial dipping apparatus 100 as it receives untreated wood article 8 from the stack of untreated articles 43 located in magazine loader 11. As radial dipping apparatus 100 rotates it holds articles 50 immersed in solution 39 in a dipping tank 12 for a predetermined length of time. After immersion in dipping tank 12 ejector member 23 ejects a treated article 9 (FIG. 3) from apparatus 100 between a set of air knives 25,26, and into radial air drying apparatus 101. The purpose of air knives 25, 26 is to blow excess treating solution 39 off the surface of treated article 9.

Radial drying apparatus 101 has a plurality of compartments 53 to hold a plurality of treated articles 51 which are dried by forcing heated air over and around articles 51 for a predetermined length of time. After drying the articles 51, radial drying apparatus 101 deposits dried article 60 into a conveyor belt 31 for transportation of the article to work stations 102 (FIG. 1). Work station 102 includes a first paint station 32 where a mist coat of paint is applied to the surface of the article, a curing station 33 for further heating and baking of the paint and coating on the articles, a paint station 34 where a full coat of paint is applied to the article, a flash treating station 35(*a*), a further drying station 35(*b*) and a humidifying statino 35(*c*) which completes the curing of the coatings on the articles.

DETAILED DESCRIPTION OF THE PREFERRED EMBODIMENT OF THE INVENTION

As shown in FIG. 1 and FIG. 3, magazine loader 11, which is supported by a floor stand 47, has a bin 19 for holding untreated articles. Attached to bin 19 is a conveying injection tray 22 that provides a guide for sliding articles into radial dipping apparatus 100. Conveying injection tray 22 has a smooth surface to permit one to slide untreated articles 43 into individual radial compartments 52, located in radial dipping apparatus 100. As shown in schematic form in FIG. 3, injector member 54 slides an untreated article 8 from the bottom of the stack of articles 43 onto conveying injection tray 22, and into a radial compartment 52 located in radial dipping appartus 100. The rate at which untreated articles 43 are ejected from magazine loader 11 is synchronized to the rate at which radial dipping apparatus 100 accepts articles for processing through a drive control mechanism (not shown) to permit continuous treating of articles. As an untreated article is removed from the bottom of magazine loader 11 gravity urges the stack of untreated articles 43 downward so that another untreated article 43 is placed into position for injection into a different compartment 52 in radial dipping apparatus 100.

Figure 2:
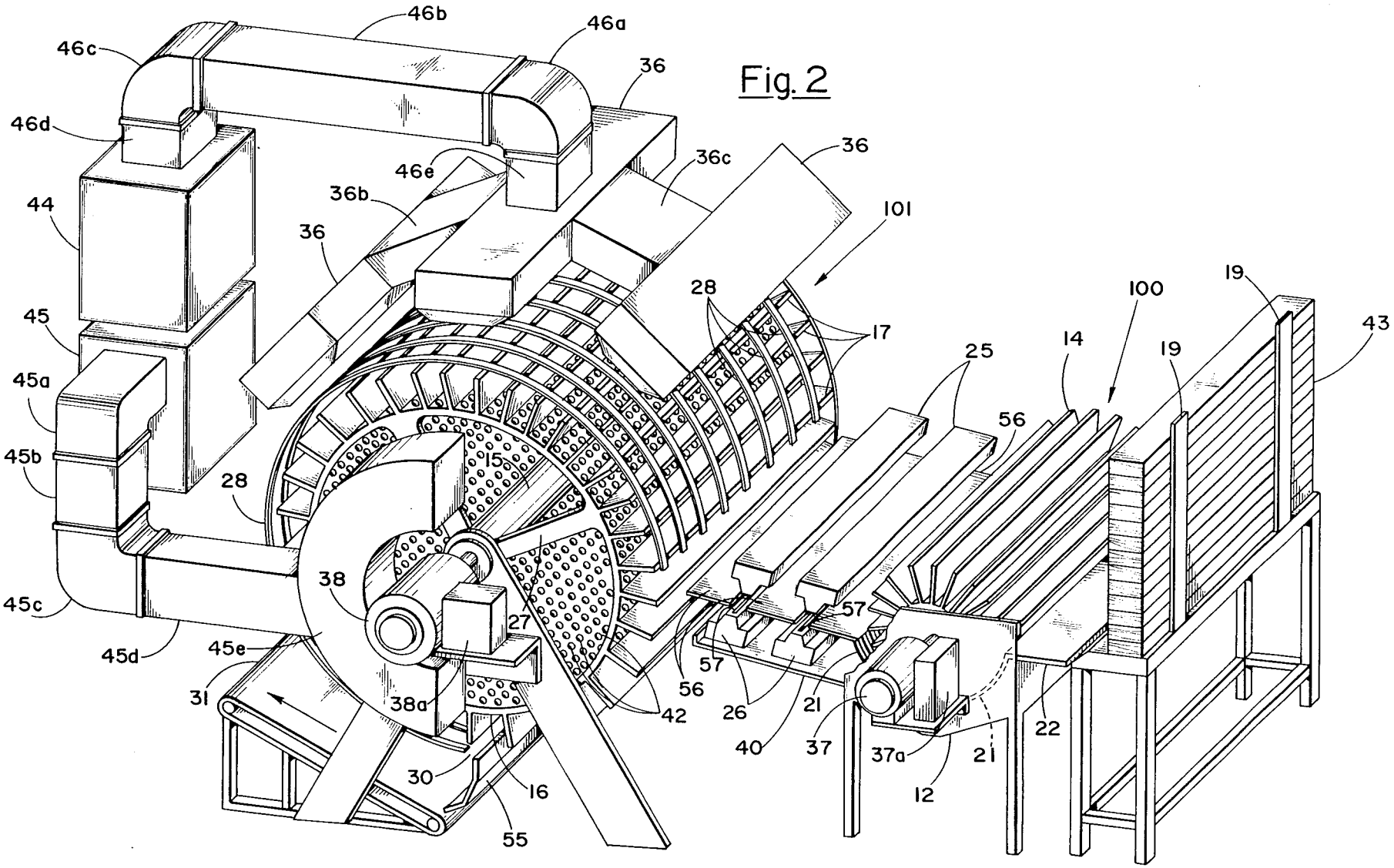
FIG. 2 is a side perspective view, partially broken away, showing the radial dipping apparatus and radial drying apparatus.

As shown in FIG. 3, radial dipping apparatus 100 includes a rotary conveying body comprising a radial dipping wheel 13 having a plurality of radially extending conveying or guide members 14 forming radially spaced compartments 52. Circumferentially spaced from the periphery of wheel 13 are a plurality of conveying guide bars 21 which hold article 50 in compartments 52 on wheel 13. Wheel 13 is shown partially submerged in dipping tank 12. Located on the right side of wheel 13 is injector member 54 and on the left side an ejector member 23 (which are shown in schematic form in FIG. 3). Typically, injector member 54 and ejector member 23 are pneumatic or hydraulically controlled machine linkages. Radial dipping wheel 13 has a substantially horizontal axis and is rotated in a clockwise direction by a motor 37 and a cam system 37(*a*) (FIG. 2). Guide members 14 project radially and outwardly from axis 90 of wheel 13 so that as wheel 13 rotates articles 50 in compartments 52 are forced through solution 39 in dipping tank 12. While guide members are shown as solid panels, it is preferable to use either a screen or cylindrical spaced guides. The advantage of screen guide members or cylindrical spaced guides is that it allows the solution 39 to circulate through the guide members as guide members force articles 50 through solution 39. The adjacent conveying guide member 14 should be sufficiently spaced to permit articles 50 to fit with substantial clearance into the compartment 52 formed between adjacent members 14. Note, as wheel 13 rotates it forces untreated articles 50 into treating solution 39, which for articles such as wood window frames and door frames is typically a solution such as xylene, mineral spirits, water based wood preservatives or stabilizers. A set of circumferentially located conveying guide bars 21 acts as barriers to keep untreated articles 50 within compartments 52 of wheel 13.

FIG. 3 shows that, as wheel 13 rotates, untreated articles 50 are floatingly displaced from trailing conveying guide member 14 of compartment 52 to the adjacent leading guide member 14 by the buoyant forces acting on article 50. As long as the density of solvent 39 is greater than the density of untreated wood article 50, the articles float from one guide member to the opposite guide member as the articles are forced through the dipping tank 12. Displacement from one conveying trailing guide member 14 to its adjacent leading guide member 14 allows exposure of the entire surface area of untreated article 50 to solvent 39 since no surface of the guide member is in continuous contact with articles 50.

Guide bars 22 which are located in spaced relationship from the end of radial guide 14 comprise a plurality of circumferentially spaced guide bars 21 which are partially submerged in immersion tank 12. Guide bars 21 are spaced from one another and circumferentially spaced suffciently far from the end of radial guide members 14 so that conveying guide members 14 rotate freely past bars 21 yet sufficiently closely spaced so as to retain articles 50 in compartments 52 between adjacent guide members 14.

In a typical treatment process of a wood window sash or frame radial dipping wheel 13 advances through 20° of rotation every 2.86 seconds, thereby immersing articles 50 for approximately 17 seconds in treating solution 39. Although FIGS. 1–3 show only a single article in compartment 52, a plurality of articles may be placed end-to-end of one another and injected into radial dipping wheel 13 as long as the total length of the articles does not exceed the width of radial dipping wheel 13 which, for treatment of wood window sashes is 34" in diameter and 110" in length.

As generally constructed, conveying guide members 14 are 1" in width and attached sufficiently far apart on radial dipping wheel 13 to prevent article 50 from wedging therebetween. Generally, the level of treating solution 39 in dipping tank 12 has an affect on the time of immersion of article 50 in solution 39. With dipping tank substantially full of solution 39, the dipping time is at a maximum for a given rotational rate of wheel 13 and as the solution 39 is used up the level of solution in tank 12 decreases thereby decreasing the time article 50 is immersed in the solution. In a typical cycle dipping tank 12 may have sufficient solvent so that rotation of wheel 13 provides a maximum of 17 second dipping time. When the liquid level of the solvent decreases to a level where the article is immersed for only 15 seconds, a control system (not shown) injects additional treating solution 39 into dipping tank 12 to raise the treating solution level in dipping tank 12 to where the article is immersed for 17 seconds. Typically, for continuously treating articles, dipping tank 12 has a volume of approximately 500 gallons.

As shown in FIG. 3, ejection member 23 drives article 9 between upper air knives 25 and lower air knives 26 and into drying compartment 53 located between a plurality of radial spaced drying guide members 17 extending from radial drying apparatus 101. Ejector member 23 is synchronized to radial dipping apparatus 100 and radial drying apparatus 101 so that articles can be continually fed from the dipping compartment 52 in dipping apparatus 100 to the drying compartment 53 in drying apparatus 101.

Upper air knives 25 and lower air knives 26 are located in a spaced position between radial dipping appartus 100 and radial drying apparatus 101. Air knives 25 and 26 each have a plurality of laterally extending slits 57 for directing pressurized air therethrough. A plurality of laterally extending openings 85 and 86 are located in guide tray 56 and proximate openings 57 in air knives 25 and air knives 26. Tray 56 supports and slidingly guides a treated article 9 as it slides from radial dipping apparatus 100 to radial drying appartus 101 (FIG. 3). Upper air knives 25 blow downwardly and lower air knives 26 blow upwardly. If air is blown at a sufficient pressure, volume and rate from air knives 25, 26 it blows excess treating solution 29 off treated article 9 and onto a drip pan 40 as article 9 slides along tray 56.

Drip pan 40, which is located beneath air knives 25, 26 is angularly and integrally attached to dipping tank 12 to permit excess treating solution 39 to drain into dipping tank 12. That is, excess treating solution 39 which is blown off treated article 9 falls onto drip pan 40 where it flows back into dipping tank 12.

A splash guard 41 extends over air knives 25 toward radial dipping appartus 100 and attaches to circumferential drying guide bars 28. Splash guard 41 prevents excess treating solution from being blown onto radial drying apparatus 101 or into the atmosphere or environment surrounding radial treating and drying system 10.

As shown in FIG. 2, radial drying apparatus 101 includes a drying body comprising a central shaft 15, a plurality of spokes or support arms 27, a porous cylindrical drum 16 and a plurality of radially extending drying guide members 17. Radial drying apparatus 15 has a substantially horizontal axis and is rotated in a counterclockwise direction by motor 38 and cam system 38(*a*). A plurality of support arms 27 extend radially and outwardly from central shaft 15 to provide an open cylindrical chamber inside drum 16. Drum 16 comprises a porous screen which has a sufficient open area so that a sufficient volume of air can be forced through compartments 53 and around treated articles 51 located in compartments 53. While a screen is shown, other restraining devices could also be used. Guide members 17 are integrally attached to and extend radially outward from drum 16 to create individual drying compartments 53. The guide members 17 are equally and radially spaced about drum 16 so that treated articles 51 located between adjacent guide members fit sufficiently loose in compartments 53 to allow gravity, at the peak of the cycle, to shift treated articles 51 from contact with trailing guide member 17 to contact with its adjacent leading guide member 17. The shifting permits the entire surface areas of treated articles 51 to be exposed to heated air blown through drying compartments 53.

Located in a spaced relationship from the end of radial guide members 17 are circumferentially spaced drying guide bars 28 which extend for approximately 270° from air knives 25 to a dryer ejection opening 30. Guide bars 28 are circumferentially spaced sufficiently far from the end of radial guide members 17 so that guide members 17 rotate freely yet spaced sufficiently close so as to retain articles 51 in compartments 53 between adjacent guide members 17. Circumferential guide bars 28 thus function as barriers to prevent treated articles 51 from being blown out of compartments 53 by either the turbulent circulating air or the gravitational force acting on articles 51.

As shown in FIG. 2, a plurality of circumferentially spaced forced air impingement nozzles 36 having a plurality of openings 36*a* are located axially above radial drying apparatus 101. Openings 36*a* are located so that air blown through impingement nozzles 36 is directed radially onto treated articles 51 located in drying compartments 53. Heated air is supplied by an air source 44, which directs the heated air to central impingement nozzle 36 through a plurality of air ducts 46*d*, 46*c*, 46*a* and 46*e*. An air duct 36*b* and an air duct 36*c* channel air from centrally located impingement nozzle 36 to adjacent impingement nozzles 36.

A return system 45 permits return of air through a plurality of inlet ducts 45*a*, 45*b*, 45*c*, 45*d* which connect to a semicircular duct 45*e*.

In typical operation radial drying apparatus 101 will normally produce articles dry-to-touch in three to five minutes where the articles have been immersed for a maximum of 17 seconds in a treating solution 39. As article 60 emerges from drying apparatus 101 the article, which is dry-to-the-touch, can be forthwith used to manufacture a window frame. If the manufacturer desires to paint article 60 before assembly of the frame, the article is sufficiently dry so that a coat of paint can be applied and cured on article 60 through the further immediate processing in work stations 102.

FIG. 2 shows a lower dryer ejection opening 30 located beneath drum 16 so that the force of gravity directs dried article 60 from drum 16 to an inclined conveyor belt 31 which is located beneath dryer ejection opening 30. FIG. 2 shows a conveyor belt 49*a* which directs article 60 into a mist coat painting station 32.

Conveyor belt 49*a* is shown transporting a mist coat painted article 61 from mist coat paint station 32. Connected to station 32 is an exhaust system 73 for directing fumes and discharges gasses to a scrubber or the like. Typically, conveyor belt 49*a* transports treated and stabilized articles at a rate of six feet per minute. Paint station 32 applies a first coat of paint to the articles. After painting mist coat conveyor belt 49*a* then transports the articles to a bake zone conveyor belt 49*b* by a means not shown.

Bake zone conveyor belt 49*b* transports articles, as shown by an article 62, through bake zone in curing station 33 at a rate of six feet per minute. Typically, the articles bake for 30 seconds at 110° F. Heat is directed to curing station 33 through a duct 65 while exhaust is channeled away from curing station 33 by an exhaust system 71. A heater and blower 69 supplies duct 65 with heated air through a plurality of air ducts 68, 67, and 66.

A bake zone conveyor belt 49*b* deposits article 62 onto a full coat conveyor belt 49*c* through means not shown. Typically belt 49*c* transports articles at a rate of six feet per minute through a full coat paint work station 34 having an exhaust system 72. Paint work station 34 applies a full coat of paint to the articles. FIG. 1 shows an article 63 being transported from paint station 34 to flash stations 35*a*.

Similarly, conveyor belt 49*c* deposits the articles thereon onto conveyor belt 49*d* by a means not shown. Belt 49*d*, upon which an article 64 is being transported, moves through a flash station 35*a*, a drying station 35*b* and a humidifying station 35*c* at a typical rate of six feet per minute. Typically, the articles are retained in flash station 35*a* for approximately 8.5 minutes, in drying station 35*b* for five minutes and in humidifying station 35*c* for two minutes.

Exhaust is channeled from station 35*a* by an exhaust system 70 and heat is supplied to drying station 35*b* by a heater 69 and a plurality of heat ducts 75 and 76.

A plurality of exhaust ducts 80, 81 and 82 are located at flashing station 35*a* and channel exhaust gasses by a fan not shown to exhaust chimney 70. Similarly, a plurality of exhaust ducts 83 and 84 are attached to drying station 35*b* and channel exhaust by a fan (not shown) to exhaust chimney 70.

Figure 4:
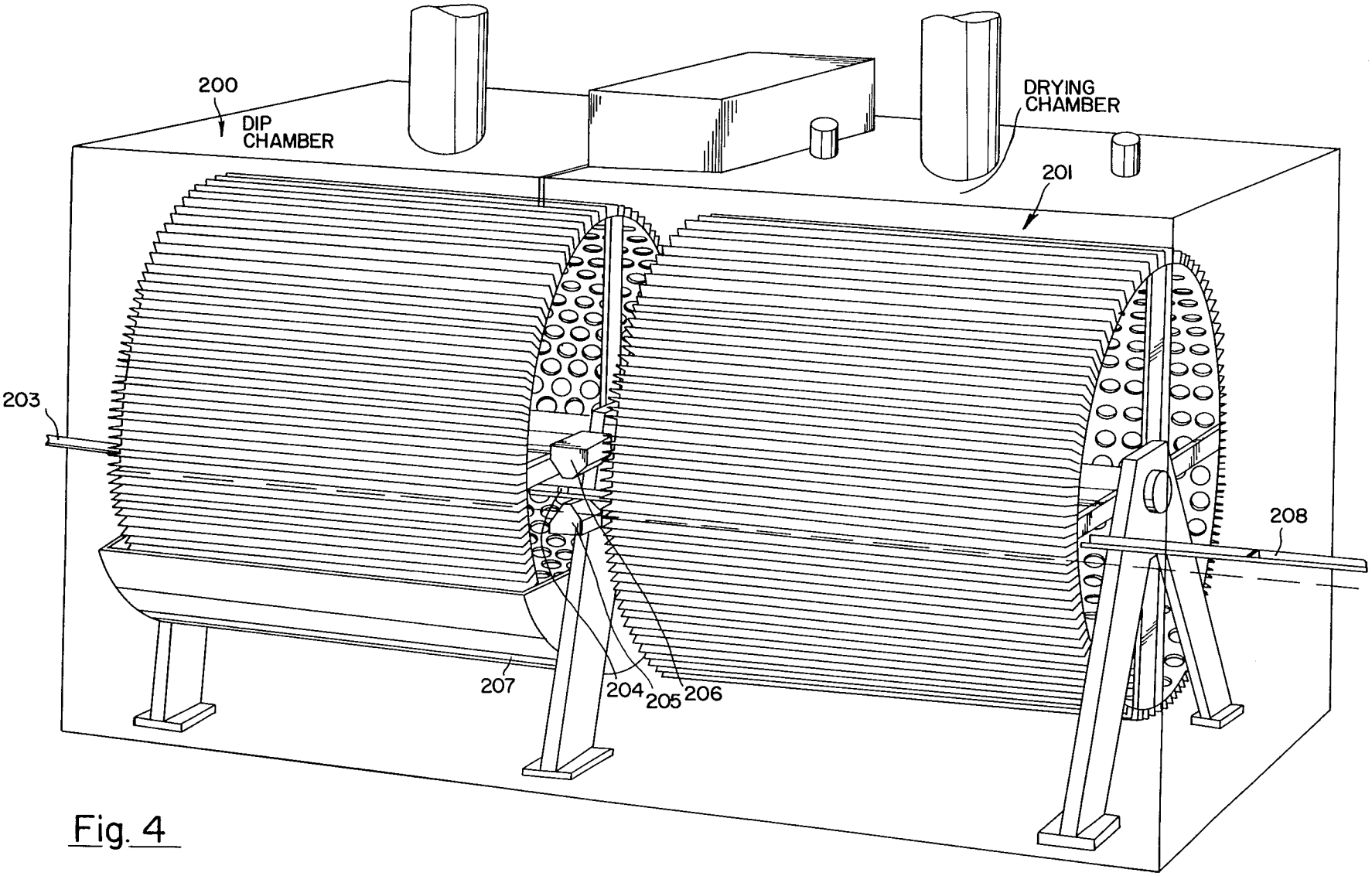
FIG. 4 is a schematic view of dipping and drying apparatus located in an end-to-end arrangement.

Referring to FIG. 4 there is shown another embodiment of my invention wherein the dipping apparatus 200 and the drying apparatus 201 are placed end-to-end rather than side-by-side. While dipping apparatus 200 and drying apparatus 201 are substantially identical in their dipping and drying functions to the side-by-side apparatus shown in FIG. 2, the end-to-end location provides certain article handling advantages.

Briefly, in operation of dip chamber 200 an article 203 is slid longitudinally into a radial compartment on dipping wheel 200. Although not shown in detail the radial compartments of dipping apparatus 200 are identical in operation and function to dipping wheel 100 except that in dipping wheel 100 the article to be treated is slid radially onto the dipping wheel while in dipping apparatus 200 the part is slid axilly into a comparatment on dipping wheel 200.

The transfer of a dipped part from dipping wheel 200 to drying apparatus 201 is likewise accomplished by axially sliding article 204 from dipping wheel 200 through a set of air knives 205 and 206 which blow off excess solvent, which is returned to solvent dipping tank 207.

After drying an article in drying apparatus 201 a dried article 205 is slid axially out of radial drying apparatus 201 for further processing.

The end-to-end location of dipping appartus 200 and drying apparatus 201 permits one to use the full 360 degree rotation of the dipping and drying wheel. By utilizing the full 360 degree rotation one extends the drip time that an article is in dipping apparatus which decreases the amount of excess solvent that has to be blown off the article by the air knives. Similarly, one also extends the drying time since the article remains in the drying apparatus for a full 360 degree rotation of drying wheel 201.

What is claimed is:

1. A system for continuously treating and drying a plurality of wood articles or the like comprising:

means for directing an article to be treated to a treating station;

further means for receiving the article from said means for directing an article to be treated and for coating the exterior surface of the article with a treating solution;

means for removing excess treating solution from the coated surface of an article;

a drying apparatus for receiving the article having a treating solution thereon and for drying the treating solution on the article so that the article is dry-to-the-touch as the article emerges from the drying apparatus, said drying apparatus including a rotatable drying apparatus that includes a drum having a plurality of radial guide members spaced about said rotatable drying appartus to create drying compartments whereby the articles therein are displaceable from one guide member to an adjacent member so that the entire surface area of the article can be dried by forcing heated air through the drying compartments; and further means for collecting and removing fumes generated during the drying process.

2. The system of claim 1 including a first painting station to apply a coat of paint to the article.

3. The system of claim 2 including a curing station to cure the paint on the article.

4. The system of claim 3 including a second painting station to apply a coat of paint to the article.

5. The system of claim 4 including a station for flash drying the paint on the article.

6. The system of claim 5 including a station for heating the article to a predetermined temperature.

7. The system of claim 6 including a station for subjecting the article to a humidifying atmosphere.

8. The system of claim 1 wherein said further means includes a plurality of guide members mounted on a rotatable dipping apparatus wherein the guide members direct an article into a dipping tank containing the treating solution.

9. The invention of claim 1 wherein said means for directing an article to be treated and for coating the external surface comprises a radial dipping apparatus having a plurality of radial compartments and a first axis of rotation, said first axis of rotation and said second axis of rotation located in the same direction so that an article can be directly transferred from a radial compartment in said dipping apparatus to a radial compartment in said drying apparatus.

10. The system of claim 1 wherein said drum has sufficient plurality of perforations so that air can be forced to flow through said drum to a return duct located proximate said drying apparatus.

11. The system of claim 10 wherein said rotatable drying apparatus has a sufficiently large diameter and a sufficient plurality of drying compartments so that said rotatable drying apparatus has a drying compartment for receiving an article drying compartment for simultaneously drying a plurality of the articles and a drying compartment for ejecting a dried article from said drying apparatus.

12. The system of claim 11 including a blower to blow hot air through said rotatable drying apparatus to dry the article in less than five minutes.

13. The system of claim 12 including a return duct for receiving the air as it is blown through said drying apparatus.

14. The system of claim 1 wherein an air knife is located adjacent to said drying apparatus for blowing excess solution off a treated article.

15. The inline method of coating and drying in one continuous process a wood article comprising the steps of:

applying a coating solution to the exterior surfaces of an article to produce a coated article by completely immersing the article in a dipping tank until the surfaces of the article are coated with the coating solution;

removing the coated article from the coating solution;

blowing off excess coating solution from the exterior surfaces of the article;

conveying the coated article to a drying apparatus and forcing heated air around the exterior surfaces of the coated article to dry the exterior surface of the article for immediate processing.

16. The method of claim 15 wherein the step of applying a coating solution includes immersion of the article in a treating solution for a predetermined length of time which is sufficient to coat the article but insufficient to saturate the article with treating solution.

17. The method of claim 16 wherein the step of removing excess treating solution from the treated article by blowing excess solution off the article.

18. The method of claim 17 wherein the step of forcing heated air around the article includes the step of moving the article through a stream of heated air to permit the heated air to contact all the exterior surfaces of the article.

19. The method of claim 18 including the step of painting the article after drying the article.

20. The method of claim 19 including the step of applying a second coat of paint to the treated article.

21. The method of claim 20 including the step of curing the paint on the article.

22. An inline system for the preparation of a wood article for use in a window frame or the like comprising:

means for coating the exterior surfaces of an article with a coating solution;

further means for removing any excess coating solution on the article;

a rotatable drying apparatus having a compartment to hold an article to permit drying the exterior surfaces of the article before the rotatable drying apparatus can complete a revolution; and an ejector for directing the coated article from the means for coating to exterior surfaces of the article into said compartment.

23. A rotatable drying apparatus for drying an article having a coating solution on its surface comprising:

a drum mounted for rotation about a central axis, said drum having a center opening and an outer peripheral region;

a plurality of guide members attached to said outer peripheral region of said drum to form drying compartments therebetween for retaining an article to be dried;

means for rotating said drum at a predetermined rate;

further means for directing heated air radially through said compartments and around an rticle located in the drying compartment so that the article can be dried before said drum has made a complete revolution; and a return air system for drawing the heated air from the center opening of said drum.

* * * * *